US010612257B2

(12) United States Patent
Wallace

(10) Patent No.: US 10,612,257 B2
(45) Date of Patent: Apr. 7, 2020

(54) SUPERVISED SWIMMING POOL GATEWAY

(71) Applicant: Francis Wallace, Antigonish (CA)

(72) Inventor: Francis Wallace, Antigonish (CA)

( * ) Notice: Subject to any disclaimer, the term of this patent is extended or adjusted under 35 U.S.C. 154(b) by 0 days.

(21) Appl. No.: 15/998,114

(22) Filed: Jul. 5, 2018

(65) Prior Publication Data

US 2020/0011078 A1 Jan. 9, 2020

Related U.S. Application Data

(60) Provisional application No. 62/604,449, filed on Jul. 7, 2017.

(51) Int. Cl.
*E04H 4/14* (2006.01)
*E04H 4/06* (2006.01)
*E04H 17/20* (2006.01)

(52) U.S. Cl.
CPC ..... *E04H 4/06* (2013.01); *E04H 4/14* (2013.01); *E04H 4/144* (2013.01); *E04H 17/20* (2013.01)

(58) Field of Classification Search
CPC ..... A47K 3/022; A63G 31/007; E01F 13/028; E04H 17/00; E04H 17/14; E04H 17/1417; E04H 17/20; E04H 17/22; E04H 3/16; E04H 4/0018; E04H 4/06; E04H 4/14; E04H 4/144; E06B 11/00; E06B 11/02; E06B 11/027; E06B 11/08; E06C 7/006
USPC ..... 4/488, 496; 49/56–57; 52/169.7
See application file for complete search history.

(56) References Cited

U.S. PATENT DOCUMENTS 2,996,729 A * 8/1961 Bailey ..... E04H 4/10 126/566
3,600,722 A * 8/1971 Diemond ..... E04H 4/0018 52/169.7
3,648,301 A * 3/1972 Wiley ..... E04H 4/0018 52/169.7
3,877,085 A 4/1975 Bukaitz et al.
3,925,830 A * 12/1975 Delaney ..... A47K 3/022 4/615
3,994,479 A 11/1976 Johannesson
4,086,669 A * 5/1978 Combis ..... A47K 3/022 4/622
4,527,297 A * 7/1985 Pettit ..... E04H 4/144 182/86

(Continued)

FOREIGN PATENT DOCUMENTS

WO WO2014100855 * 7/2014 ..... E04H 17/16

*Primary Examiner* — Erin Deery
*Assistant Examiner* — Nicholas A Ros
(74) *Attorney, Agent, or Firm* — Mario Theriault

(57) ABSTRACT

The swimming pool gateway has a gate that is best operated by an adult and a banner demanding attention for the presence of a responsible adult near the pool when there are children in the pool. The gateway has a front panel and a back panel. The front panel comprising a gate, and the back panel being mounted between the pool and the ladder of the pool. The back panel has a recess in a top rail thereof for integrally enclosing the ladder. The gateway has fencing panels that are assembled using six bolts. The gate has an arch there-over, and an inverted U-shaped frame is pivoted to the arch. This U-shaped frame has a latch mechanism to lock the gate when the U-shaped frame is in a lower position, and the U-shaped frame displays the banner when it is rotated to its upper position.

4 Claims, 5 Drawing Sheets

(56) References Cited

U.S. PATENT DOCUMENTS

| | | | | | |
|---|---|---|---|---|---|
| 4,997,061 | A * | 3/1991 | Aymes | E04H 4/144 | 182/106 |
| 5,080,192 | A | 2/1992 | Kerr | | |
| 5,354,036 | A | 10/1994 | Brown | | |
| 5,641,035 | A * | 6/1997 | Pettit | E04H 4/0018 | 182/118 |
| 6,102,156 | A * | 8/2000 | Lipniarski | E04F 11/1043 | 182/115 |
| 6,123,321 | A | 9/2000 | Miller | | |
| 6,830,127 | B2 | 12/2004 | Johnson | | |
| 7,389,573 | B2 | 6/2008 | Pesta | | |
| 7,765,737 | B2 * | 8/2010 | Kain | E06B 11/02 | 49/95 |
| 7,887,029 | B2 | 2/2011 | Flannery | | |
| 8,490,811 | B2 * | 7/2013 | Erlich | A45C 7/0077 | 220/9.2 |
| 8,502,665 | B2 | 8/2013 | Boudreau | | |
| 8,584,409 | B1 | 11/2013 | Hibbard | | |
| 8,763,303 | B2 * | 7/2014 | Johnson | A01G 13/0225 | 47/32.4 |
| 2018/0311558 | A1 * | 11/2018 | Rowland | E04H 4/144 | |

* cited by examiner

SUPERVISED SWIMMING POOL GATEWAY

This patent application claims the benefit of U.S. Provisional Application No. 62/604,449, filed Jul. 6, 2017.

FIELD OF THE INVENTION

This invention pertains to swimming pool safety. More particularly, it pertains to childproof gateways for installation around ladders of swimming pools.

BACKGROUND OF THE INVENTION

Accidents in backyard pools are tragic. In most cases the life of a child is lost. It is believed that not enough preventive measures are available to pool owners. Children are too often left unattended while insouciant parents chat in the shade.

A search in the prior art for pool fencing has given the following publications:

U.S. Pat. No. 3,994,479 issued to B. Johannesson on Nov. 30, 1976;

U.S. Pat. No. 8,502,665 issued to E. Boudreau on Aug. 6, 2013.

In both examples, fencing panels are installed to the rim of a pool, and in the second example, the fence is relatively low and connected to an alarm system to indicate when it has been climbed over.

The fencing systems from the prior art are probably safe for toddlers. However, it is believed that a better system is required to hold back school-age to pre-teen children.

Although the inventions found in the prior art deserve undeniable merits, there continues to be a need for better preventative measures to reduce the number of accidents in backyard pools.

SUMMARY OF THE PRESENT INVENTION

In the present invention, there is provided a swimming pool gateway having a gate that is best operated by an adult, and a banner demanding attention for supervision of the pool by an appointed parent.

In one aspect of the swimming pool gateway, there is provided a ladder and a gateway enclosing the ladder. The gateway has fencing panels defining a fenced area. This fenced area comprises a front panel and a back panel. The front panel includes a gate, and the back panel is mounted between the pool and the ladder, behind the ladder. The back panel has a recess in a top rail thereof. This recess is made for integrally enclose the ladder.

In another aspect of the swimming pool gateway, the fenced area comprises four corner posts including a gate corner posts. The two side panels have these corner posts pre-affixed thereto, one at each end thereof. The gate is connected to the gate corner posts by hinges and the front and back panels are connected to the other three corner posts by two bolts in each of the three corner posts.

In yet another aspect of the swimming pool gateway, the gate has an arch there-over, and an inverted U-shaped frame is pivoted to the arch. This U-shaped frame has a latch mechanism mounted thereto to lock the gate when the U-shaped frame is in a lower position. The U-shaped frame displays the banner when it is rotated to its upper position. The gate is unlocked when the banner is up.

This brief summary has been provided so that the nature of the invention may be understood quickly. A more complete understanding of the swimming pool gateway can be obtained by reference to the following detailed description of the preferred embodiment thereof in connection with the attached drawings.

BRIEF DESCRIPTION OF THE DRAWINGS

A preferred embodiment of the swimming pool gateway according to the present invention is described with the aid of the accompanying drawings, in which like numerals denote like parts throughout the several views.

The drawings presented herein are presented for convenience to explain the functions of all the elements included in the preferred embodiment of the present invention. Elements and details that are obvious to the person skilled in the art may not have been illustrated. Conceptual sketches have been used to illustrate elements that would be readily understood in the light of the present disclosure. These drawings are not fabrication drawings, and should not be scaled.

DESCRIPTION OF THE PREFERRED EMBODIMENT

Figure 1:
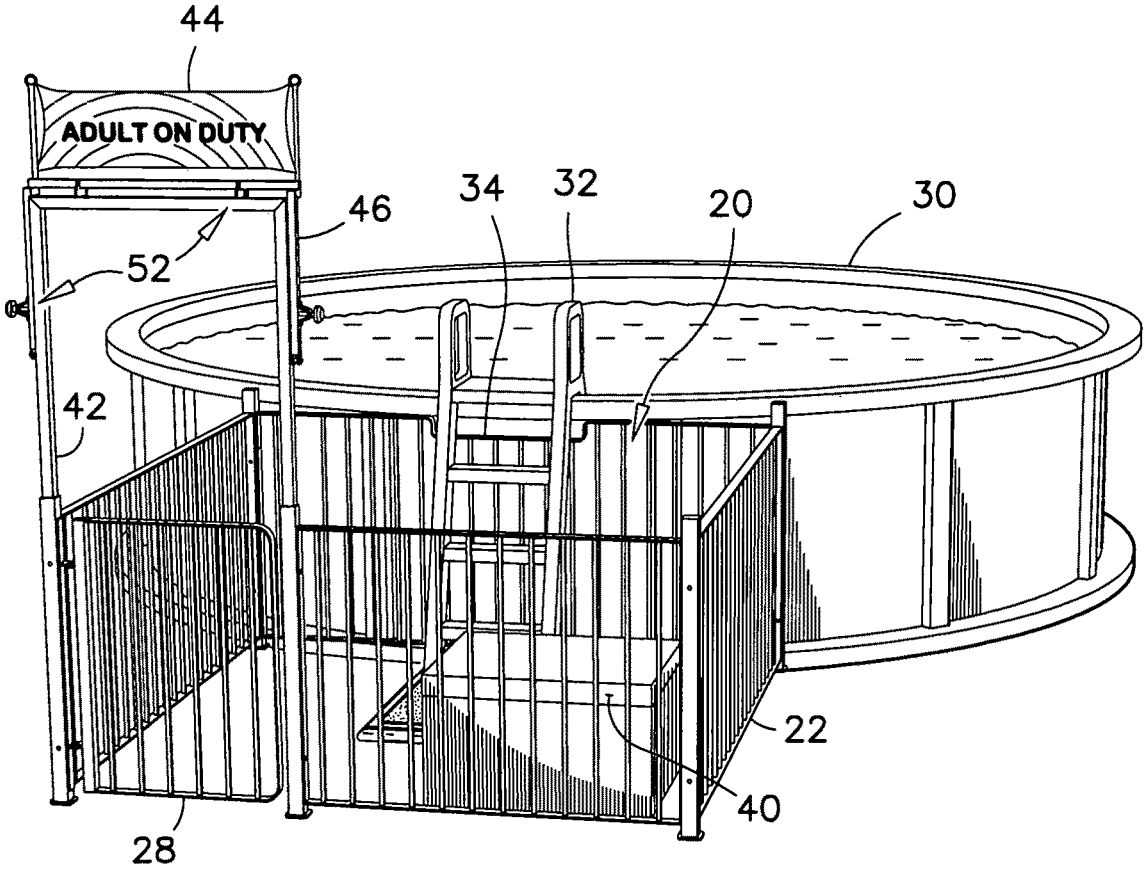
FIG. 1 is a perspective representation of the swimming pool gateway with the banner in the upper position and the gate unlocked.
Figure 2:
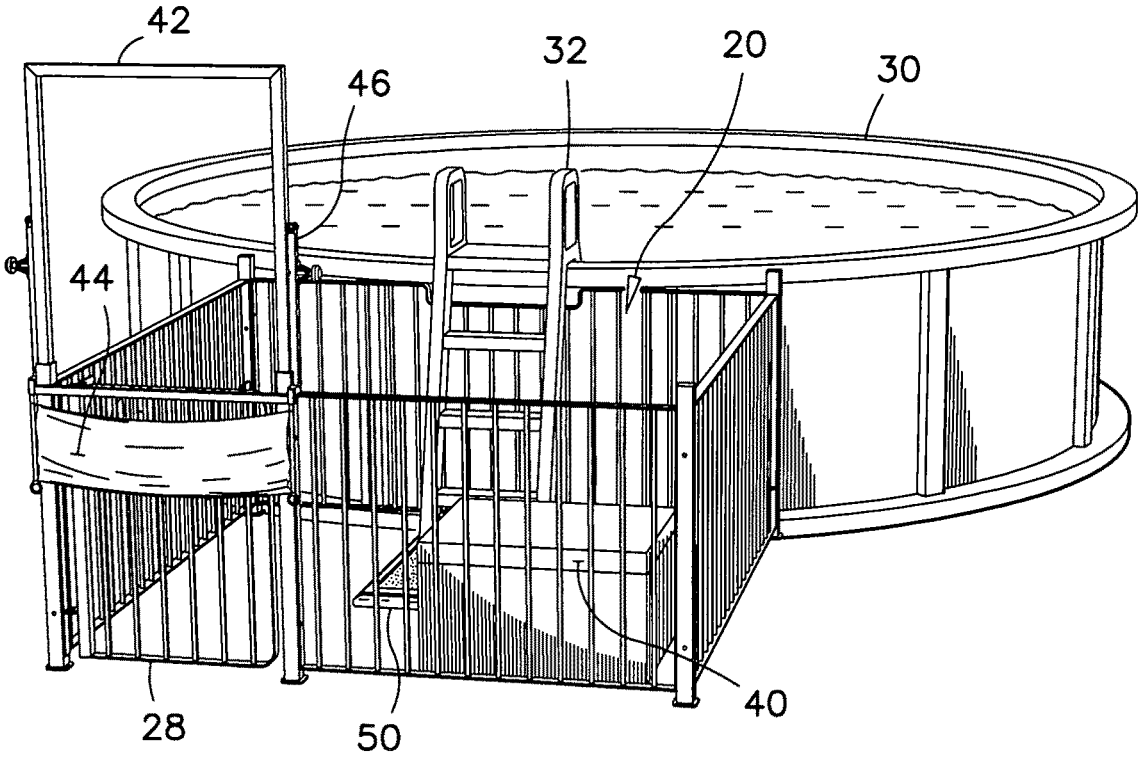
FIG. 2 is a perspective representation of the swimming pool gateway with the banner in the lower position and the gate locked.
Figure 3:
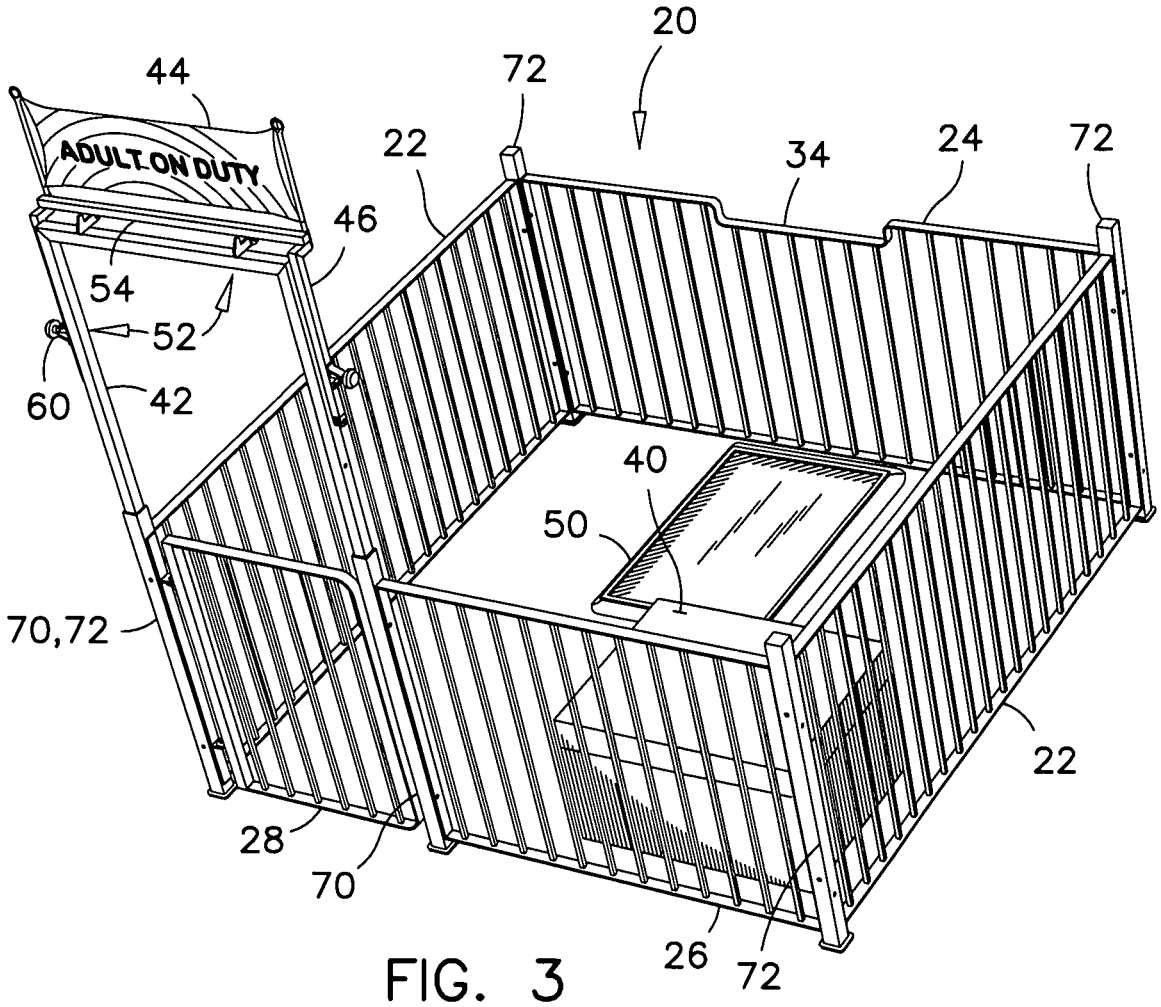
FIG. 3 is a perspective front, right side and top view of the swimming pool gateway, with the banner in the upper position.

Referring firstly to FIGS. 1, 2 and 3, there are disclosed therein the swimming pool gateway in two different modes, and in a top perspective view, respectively. The swimming pool gateway comprises a fenced area 20, which is made of four fencing panels; two side panels 22, a rear panel 24, a front panel 26 with a gale 28. The gate 28 preferably has a D-shaped outline to indicate "danger" in a subtle way.

The side panels 22 are mirror images of each other. The fenced area 20 is made to be installed near an above-ground swimming pool 30. The fenced area 20 is made to enclose the access ladder 32 of the swimming pool 30, to prevent children from going into the pool without supervision.

The fenced area 20 is made to integrate with the ladder 32 of the swimming pool 30. The fenced area 20 is integrative with the swimming pool setting by way of a recess 34 in the top rail of the back fencing panel 24. The depth and width of this recess 34 are made to fit under the specific ladder 32 that is used by the buyer of the swimming pool gateway. This recess 34 makes it easy to install the swimming pool gateway without modification to the design setting, angle and relative position of the ladder 32 currently in use with a pool 30.

The fenced area 20 is preferably large enough to accommodate 6-10 children at the time, and to provide sufficient space to allow them to don a life jacket, floating wings, goggles, foot fins and the like. The pool gateway also preferably comprises a storage chest 40 therein which is large enough to store pool accessories for these kids, when the accessories are not used.

The gate 28 of the fenced area 20 comprises an arch 42 and a banner 44 mounted on an inverted U-shaped frame 46 bordering the arch 42. The inverted U-shaped frame 46 is pivoted to the sides of the arch 40. When the inverted U-shaped frame 46 is moved to its upper position, as in FIG. 1, the banner 44 is deployed above the arch 42. The banner 44 is preferably decorated by vivid colors such as a rainbow for example.

The banner 44 in the deployed mode preferably carries a printed message such as "Adult On Duty", that is visible from a distance from the pool 30 by people far outside the fenced area 20. This is to encourage a group of parents gathering near a swimming pool to appoint one of them to supervise the children in the swimming pool.

When the inverted U-shaped frame 46 is in the lower position, as illustrated in FIG. 2, the banner 44 overlaps the gate 28, and a portion of the inverted U-shaped frame 46 locks the gate 28 in a closed position, for preventing access to the fenced area 20. When the banner is in this lower position, it faces toward the gate; toward the inside of the fenced area 20 where it is not visible to people outside the fenced area 20.

The presence of the banner 44 on the swimming pool gateway and its message "Adult on Duty" demands attention and calls for an adult volunteer to remain inside the fenced area 20. The presence of this banner 44 makes it natural, intended and expected to have at least one parent present in the fenced area 20 whenever there are children in the pool. Should the appointed parent leaves his/her post, the absence can be noticed at once, and one of the onlooking parents can volunteer to fill the void.

The preferred fenced area 20 also contains a foot bath 50 as shown in FIGS. 1-3, to wash out grass and sand from the bather's feet before entering into the pool. This bath 50 is preferably laid at the foot of the ladder 32, to enclosed the bottom end of the ladder for example. This bath 50 preferably has low and inwardly inclined side walls to prevent tripping there-over.

Figures 4, 5:
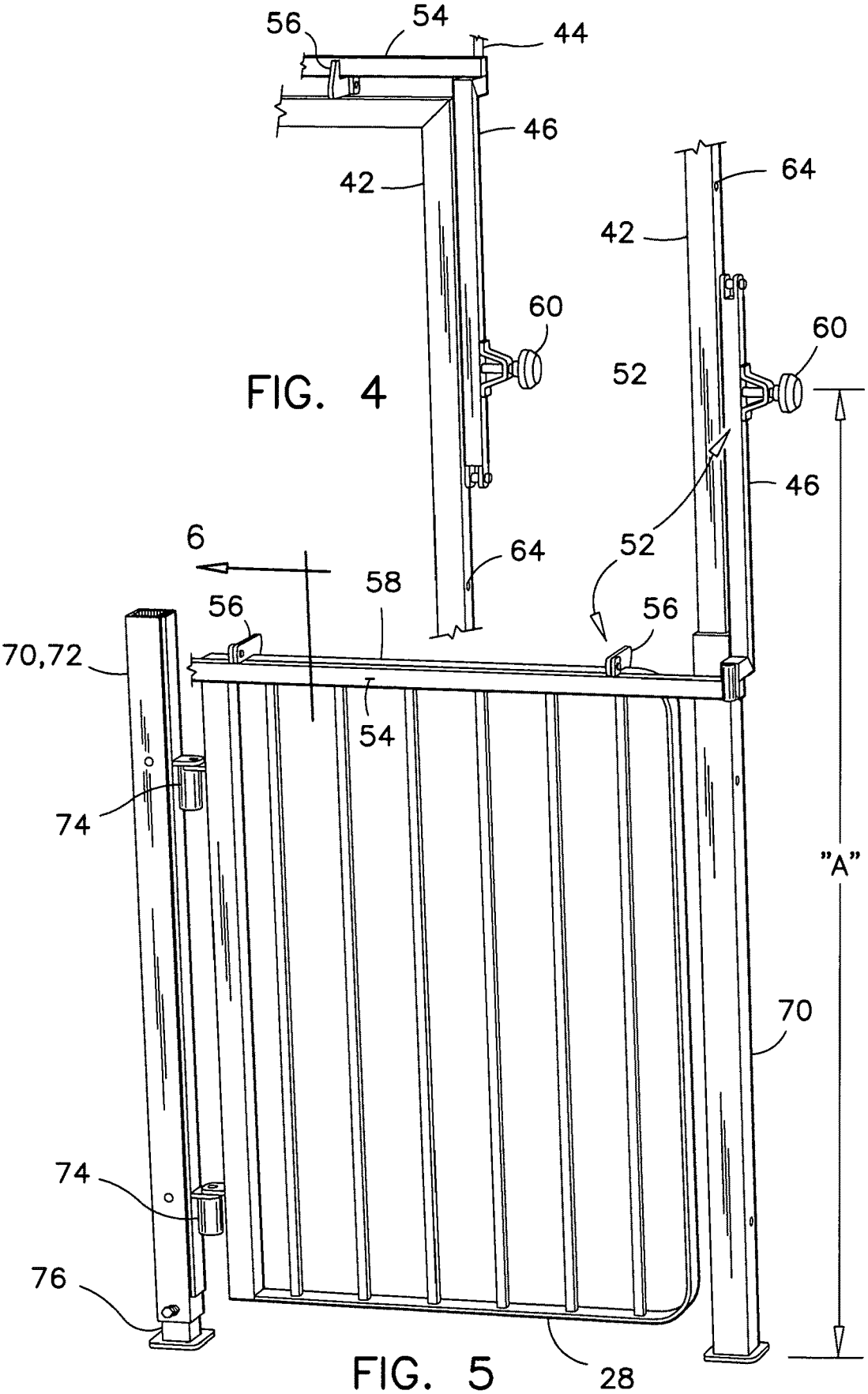
FIG. 4 partly illustrates one side of the arch over the gate with the banner in the upper position.
FIG. 5 partly illustrates the side of the gate illustrated in FIG. 4, with the banner in the lower position.
Figure 6:
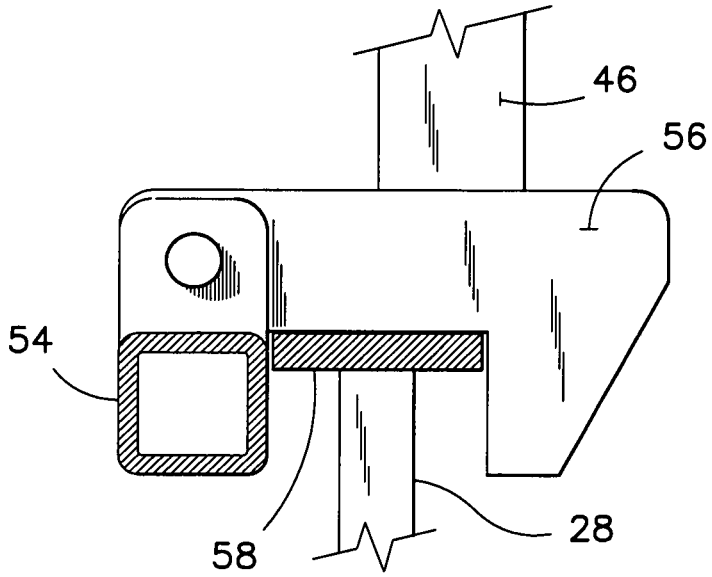
FIG. 6 is a cross-section view of the gate latch as seen along line 6 in FIG. 5.
Figure 7:
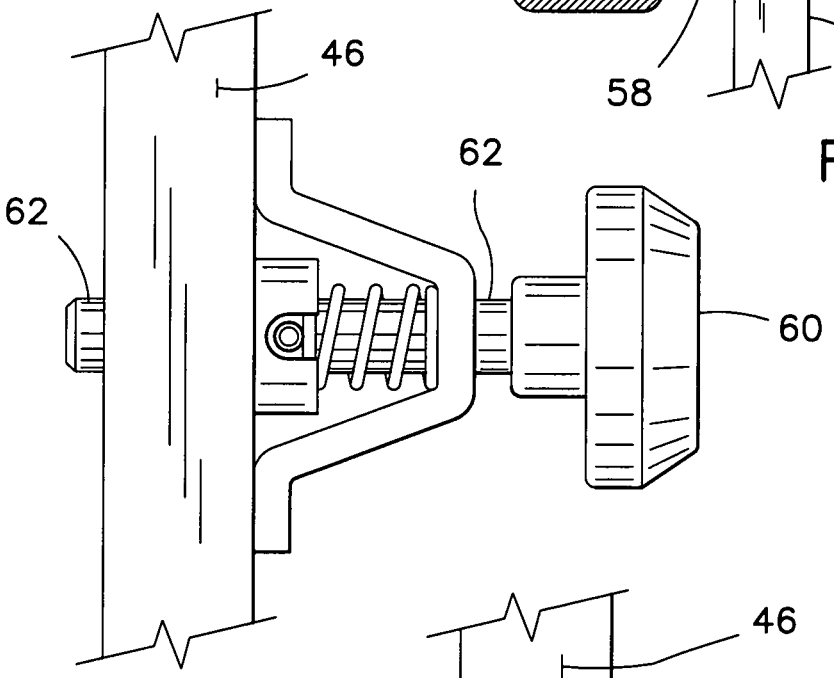
FIGS. 7 and 8 show the lock pin on the gate latch mechanism in a locked and retracted positions respectively.
Figure 8:
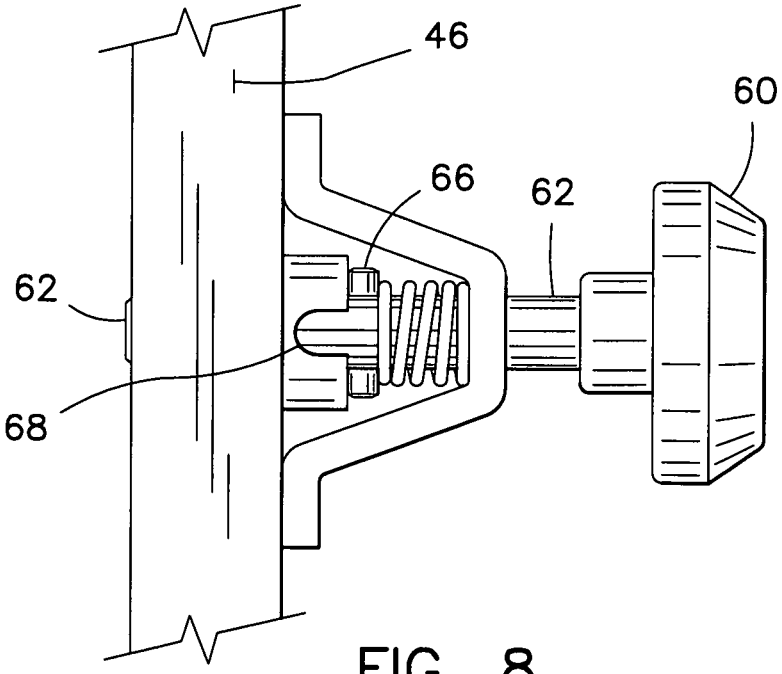

Referring now to FIGS. 3 to 8 the structure of the latch mechanism 52 will be explained. The horizontal bar 54 of the inverted U-shaped frame 46 has at least one latch dog 56 pivoted thereto. The inverted U-shaped frame 46 has dimensions so that when it is in the lower position as illustrated in FIG. 5, the horizontal bar 54 comes to rest against the top rail 58 of the gate 28. The latch dog 56 slide over the top rail 58 and holds the top rail 58 against the horizontal bar 54 to retain the gate 28 in a locked mode, as illustrated in FIG. 6.

Both leg members of the inverted U-shaped frame 46 have a latch handle 60 thereon. Each latch handle 60 has a spring-assisted pin 62 therein. Each pin 62 is made to extend into one of holes 64 in the arch 42, as can be understood from FIGS. 4 and 5. Each pin 62 extends into a respective hole 64 when the knob 60 is at rest, as in FIG. 7. Each pin 62 can be retracted by pulling on the respective knob 60 and rotating the knob 60 a quarter of a turn to retain the cross pin 66 thereof out of its seat 68 as it is well known in lock pin mechanisms. The knobs 60 are preferably positioned at a height "A" of at least 60 inches from the ground, when the inverted U-shaped frame 46 is in the lower position.

Having explained the structure of the latch mechanism 52, the operation of the gate 28 will be described.

It will be appreciated that because both knobs 60 are located on both sides of the gate 28, at natural arm reach, these knobs 60 are perceived to be operable simultaneously by both hands. Being located at 60 inches from the ground, and perceivably operated in pair, these knobs 60 are perceived by a child as being operable by an adult.

Once the pins 62 of the knobs 60 are in their retracted position, the latch dog(s) 56 must be lifted together as the horizontal bar 54 is moved away from the gate 28. The inverted U-shaped frame 46 is then tilted to it upper position as shown in FIGS. 1 and 3, and secured in place by unlatching the knobs 60 to slide the respective pins 62 in one of the upper holes 64. Again, this is a complex motion at high reach that is hardly effected by a child.

Referring again to FIG. 5, the fenced area 20 has gate corner posts 70 on each side of the gate 28, and three more fence corner posts 72. The gate corner posts 70 are preferably made of hollow structural member, and the arch 42 is preferably mounted inside these posts 70 in a telescoping manner.

The gate 28 is preferably hinged to a gate corner post 70 by saloon-door-type hinges 74, wherein the gate 28 can be easily pushed in or out.

Two or all corner posts 70,72 preferably has leveling jacks 76 on the lower end thereof. Although a telescoping jack 76 is illustrated, other leveling jacks can be used to set the fenced area 20 on level.

Figure 9:
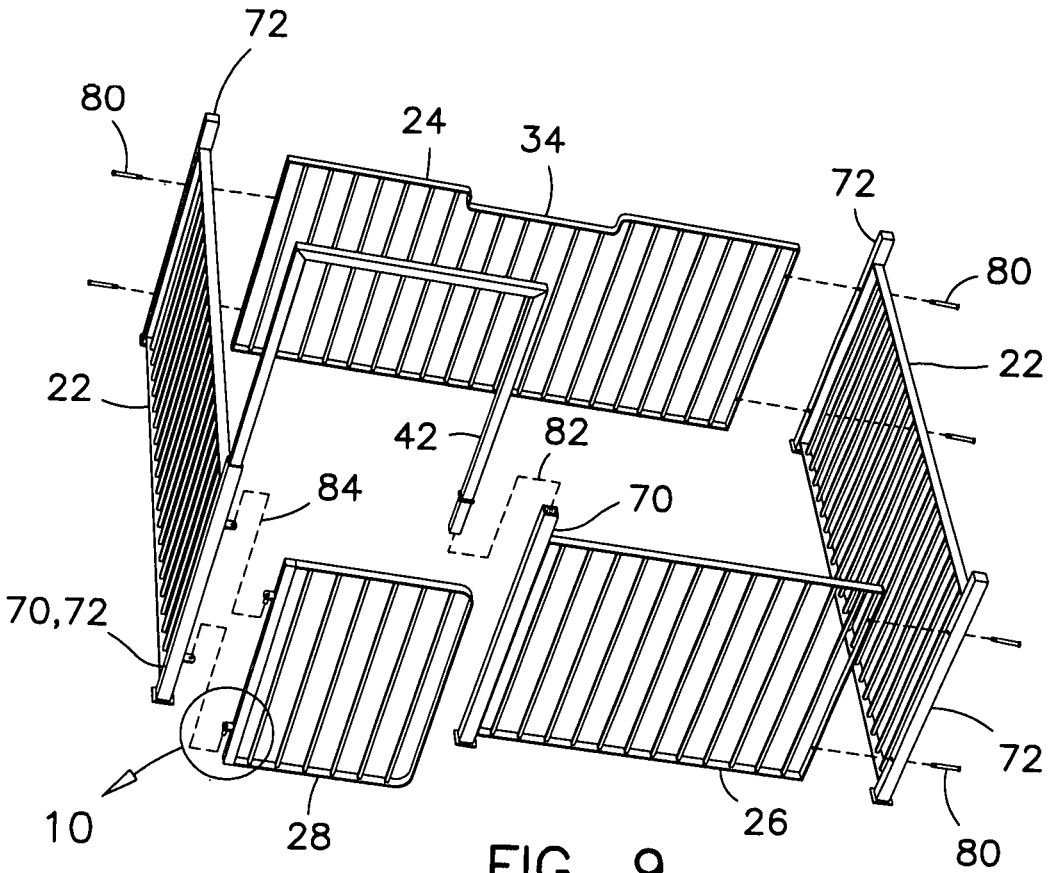
FIG. 9 illustrates the fence of the swimming pool gateway in an exploded mode.
Figure 10:
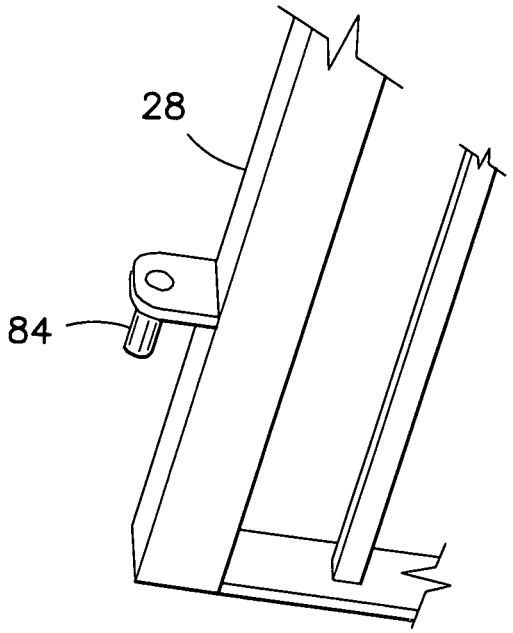
FIG. 10 is an enlarged view of a hinge pin on the gate, as seen in detail 10, in FIG. 9.

Referring now to FIGS. 9 and 10, the fenced area 20 is illustrated in a pre-installation mode, as on an instruction brochure given to a buyer for example. Preferably, the two side panels 22 of the fenced area 20 have their fence corner posts 72 pre-attached to them. The front panel 26 has a gate corner post 70 attached to it. The back panel 24 has no post attached thereto so it can easily slid under the ladder 32 of a swimming pool and set in place, as a first step during installation of the gateway. Both ends of the back panel 24 and the right hand side end of the front panel 26 are readily bolted to the fence corner posts 72, using two bolts 80 in each connection. It will be appreciated that the entire fenced area 20 can be assembled using only six bolts 80.

The arch 42 is telescopically mounted in the hollow gate posts 70 as indicated by dashed line 82. Similarly, the gate 28 is installed without tools by way of pin-type hinges 84, whether these hinges are the saloon-door type hinges 74 mentioned before or not, as can be understood from the illustration in FIG. 10.

While one embodiment of the present invention has been illustrated in the accompanying drawings and described herein above, it will be appreciated by those skilled in the art that various modifications, alternate constructions and equivalents may be employed. Therefore, the above description and illustrations should not be construed as limiting the scope of the invention, which is defined in the appended claims.

What is claimed is:

1. A swimming pool comprising a ladder and a gateway enclosing said ladder; said gateway comprising fencing panels defining a fenced area, said fencing panels comprising a front panel and a back panel;

said front panel comprising a gate;

said back panel being mounted between said pool and said ladder and having a recess in a top rail thereof; and said recess being located under said ladder;

wherein said fencing panels further comprise two side panels and four corner posts comprising three fence corner posts and a gate corner post;

said two side panels having said corner posts pre-affixed thereto, one at each end thereof; said gate being connected to said gate corner post by hinges and said front and back panels being connected to said three fence corner posts by two bolts in each of said three fence corner posts;

further comprising an arch mounted over said gate and an inverted U-shaped frame pivoted to said arch and a banner mounted to said inverted U-shaped frame.

2. The swimming pool as claimed in claim 1, wherein said inverted U-shaped frame having an upper position and a lower position, and a latch mechanism for locking said gate when said inverted U-shaped frame is pivoted to said lower position.

3. The swimming pool as claimed in claim 2, wherein said inverted U-shaped frame has latch knobs thereon for enabling a movement of said inverted U-shaped frame from said upper position to said lower position, and said latch knobs being located at 60 inches from the ground, when said inverted U-shaped frame is in said lower position.

4. The swimming pool as claimed in claim 2, wherein said banner facing away from said pool when said inverted U-shaped frame is in said upper position and said banner facing said gate when said inverted U-shaped frame being in said lower position.

* * * * *